US011499268B2

(12) United States Patent
Erlendsson

(10) Patent No.: US 11,499,268 B2
(45) Date of Patent: Nov. 15, 2022

(54) BEND FATIGUE RESISTANT BLENDED ROPE

(71) Applicant: HAMPIDJAN HF., Reykjavik (IS)

(72) Inventor: Hjortur Erlendsson, Kopavogur (IS)

(73) Assignee: Hampidjan hf, Reykjavik (IS)

( * ) Notice: Subject to any disclaimer, the term of this patent is extended or adjusted under 35 U.S.C. 154(b) by 70 days.

(21) Appl. No.: 16/758,816

(22) PCT Filed: Nov. 1, 2018

(86) PCT No.: PCT/IS2018/050011

§ 371 (c)(1),
(2) Date: Apr. 23, 2020

(87) PCT Pub. No.: WO2019/087215

PCT Pub. Date: May 9, 2019

(65) Prior Publication Data

US 2021/0180249 A1 Jun. 17, 2021

Related U.S. Application Data

(60) Provisional application No. 62/580,370, filed on Nov. 1, 2017.

(51) Int. Cl.

| | |
|---|---|
| ***D07B 1/02*** | (2006.01) |
| ***D07B 1/16*** | (2006.01) |
| ***D07B 1/14*** | (2006.01) |
| *D07B 5/12* | (2006.01) |

(52) U.S. Cl.

CPC ..... *D07B 1/025* (2013.01); *D07B 1/162* (2013.01); *D07B 1/142* (2013.01); *D07B 5/12* (2013.01); *D07B 2201/102* (2013.01); *D07B 2201/1096* (2013.01); *D07B 2205/205* (2013.01); *D07B 2501/2061* (2013.01)

(58) Field of Classification Search

CPC ..... D07B 1/025; D07B 1/142; D07B 1/162; D07B 2201/102; D07B 2201/1096

See application file for complete search history.

(56) References Cited

U.S. PATENT DOCUMENTS

| | | | | |
|---|---|---|---|---|
| 3,960,050 A * | 6/1976 | Eisler | ..... | D07B 1/025 87/1 |
| 4,202,164 A * | 5/1980 | Simpson | ..... | D07B 1/025 57/231 |
| 4,345,339 A | 8/1982 | Miller et al. | | |

(Continued)

FOREIGN PATENT DOCUMENTS

| | | |
|---|---|---|
| EP | 0 041 111 | 9/1983 |
| WO | WO 2004/020732 | 3/2004 |
| WO | WO 2017/199267 | 11/2017 |

*Primary Examiner* — Shaun R Hurley
(74) *Attorney, Agent, or Firm* — Donald E. Schreiber

(57) ABSTRACT

Disclosed is a blended rope having an outer sheath (8) enclosing at least a strength member (7), the strength member (7) having high-strength synthetic fibers, the strength member (7) being a blended strength member (7) formed with a combination of ARAMID fibers and HMPE fibers, the blended strength member comprising a non-homogeneous distribution of the ARAMID and HMPE fibers, wherein the weight ratio of ARAMID to HMPE in the strength member (7) is preferably a minimum of 80:20.

19 Claims, 1 Drawing Sheet

(56) References Cited

U.S. PATENT DOCUMENTS 4,534,163 A * 8/1985 Schuerch ..... D07B 1/04 57/233
4,550,559 A 11/1985 Thomson
5,358,262 A * 10/1994 Roberts ..... F16J 15/0812 277/652
5,468,327 A * 11/1995 Pawlowicz ..... D04C 1/02 156/393
5,749,214 A * 5/1998 Cook ..... B29C 55/065 264/290.5
5,771,673 A 6/1998 Lorch
6,050,077 A * 4/2000 Muller ..... A63B 29/028 57/210
6,314,711 B1 * 11/2001 De Angelis ..... D07B 1/162 57/210
7,134,267 B1 * 11/2006 Gilmore ..... D02G 3/047 57/237
7,908,955 B1 * 3/2011 Chou ..... D04C 1/00 87/8
8,109,072 B2 2/2012 Chou et al.
8,863,630 B2 * 10/2014 Erlendsson ..... D07B 1/02 87/6
2004/0069132 A1 * 4/2004 Knudsen ..... D07B 1/162 87/1
2005/0160714 A1 * 7/2005 Delvael ..... D07B 1/02 57/232
2007/0202331 A1 * 8/2007 Davis ..... D07B 1/025 428/375
2009/0301052 A1 * 12/2009 Chou ..... D02G 3/045 57/237
2012/0297746 A1 * 11/2012 Chou ..... D07B 1/02 57/230
2014/0196596 A1 * 7/2014 Padilla ..... D04C 1/12 87/6
2016/0221805 A1 * 8/2016 Munuswamy ..... B66C 23/62
2017/0145631 A1 * 5/2017 Rommel ..... D07B 1/02
2019/0119850 A1 4/2019 Erlendsson
2019/0301089 A1 * 10/2019 De Sousa Faria ..... B66C 13/00

* cited by examiner

BEND FATIGUE RESISTANT BLENDED ROPE

This patent application claims priority under 35 U.S.C. § from Patent Cooperation Treaty ("PCT") International Patent Application no. PCT/IS2018/050011 filed 1 Nov. 2018, which claimed priority from U.S. Provisional Patent Application No. 62/580,370 filed with the United States Patent and Trademark Office ("USPTO") on 1 Nov. 2017.

TECHNICAL FIELD

A large diameter rope for heavy lifting, mooring and towing applications, such as a high-strength synthetic strength membered rope that is capable of being used with high tension blocks such as drums, winches and sheaves in applications requiring frequent bending and travelling around sheaves and on drums and winches while the rope is under tension.

The present disclosure's synthetic ropes include but are not limited to crane ropes, deep sea deployment and recovery ropes, tow ropes, towing warps, trawl warps (also known as "trawlwarps"), deep sea lowering and lifting ropes, powered block rigged mooring ropes, powered block rigged oil derrick anchoring ropes used with blocks and also with powered blocks, superwides and paravane lines used in seismic surveillance including but not limited to used with towed arrays, yachting ropes, rigging ropes for pleasure craft including but not limited to sail craft, running rigging, powered block rigged anchor ropes and other industrial applications.

BACKGROUND ART

Blended synthetic strength membered ropes formed of a combination of ARAMID fibers and High-Modulus Polyethylene (HMPE) fibers (including UHMWPE fibers) are well known in the art and have been proposed, without success, as replacements to steel wire rope for use with high tension blocks.

Thus far, none of the known art has proposed a rope construction and manufacture process as taught in the present disclosure.

It is important to provide a high-strength fiber synthetic strength membered rope to substitute steel wire rope because, unlike steel wire rope, strength members formed from high-strength synthetic fibers do not store appreciable amounts of kinetic energy. Due to storage of large amounts of kinetic energy, when steel wire rope breaks it poses a serious threat to anyone nearby. The combination of the enormous kinetic energy of a steel wire rope under a high strain with the heavy weight of the steel wire causes recoil with incredible force. That recoil is highly unpredictable, flying back in a snake-like manner. Each year persons and especially crew are maimed and killed by recoiling ruptured steel wire rope. These personnel are often working in manual labor environments in undeveloped regions having lower safety standards in comparison to developed nations with regards to ensuring worker safety. In order to speed the adoption of safer substitutes for steel wire rope, such substitutes must be made more economical to the operator in comparison to steel wire rope. The key factor to making synthetic substitutes to steel wire rope more economical is to increase their service life.

In some applications known high-strength synthetic fiber strength membered ropes are not an economic substitute for steel wire, especially in applications requiring dynamic use with high tension blocks, such as drums and winches, meaning, a use where the rope experiences periods of time combining constant travelling and constant bending on blocks while under high tensions, such as tensions at the working load of the ropes strength member. Examples of such an application is a crane rope. The main reason that known high-strength synthetic strength membered ropes are not economical substitutes for steel wire rope in such applications is that known high-strength synthetic strength membered ropes deteriorate rather rapidly in such applications in comparison to steel wire rope and thus have a lesser service life in such applications in comparison to steel wire rope. A main causative factor for the rather rapid deterioration is bend fatigue that occurs when the rope is being bent while also travelling and while also under tension. The bend fatigue, when experienced at high strains for prolonged periods of time, generates heat energy that accumulates within the rope's strength member and causes accelerated destruction of the rope's strength member.

It thus can be appreciated that in order to form a synthetic rope substitute for steel wire rope for applications requiring dynamic use with high tension blocks that the synthetic rope must be both highly heat tolerant as well as incapable of storing significant kinetic energy.

ARAMIDs are considered a highly heat tolerant high-strength synthetic fiber that also are incapable of storing significant kinetic energy. However, ARAMIDs are widely known to be a poor material for general rope construction. Practice has proved that crane ropes, trawler warps, dynamic mooring ropes and other ropes formed with ARAMID fibers for the ropes strength member fail rapidly and without warning in such applications and generally in applications requiring dynamic use with high tension blocks in comparison to steel wire ropes. Thus, such ropes have not been adopted into the industry, and it is contrary to the state of the art and against the trend in the industry to form the strength member of such ropes from ARAMID fibers.

Therefore, it can be appreciated that it is a widely held belief in the industry and the state of the art and the trend in the industry that ARAMID fibers are not suitable form forming a rope that solves the instant discussed problem.

High Modulus Polyethylene (HMPE) fibers experience the least fiber to fiber friction of any of the high-strength synthetic. However, experience and practice have proved that ropes formed with HMPE fibers forming their strength member experience too much heat energy accumulation internal the rope's strength member despite the relatively low friction of HMPE fiber and ropes formed with HMPE forming their strength members also have proved a failure in the instant application and have not solved the instant discussed problem and are considered unsuitable by the industry for forming a rope for the instant discussed application.

More recently, attempts to solve this problem focus on blending ARAMID fibers with HMPE fibers in forming the ropes strength member. Various constructions of high-strength synthetic strength members incorporating a combination of blending such fibers are well known in the art. It is the state of the art and the trend in the industry that when forming such a strength member that there is a homogeneous distribution of the HMPE and the ARAMID fibers in each of the main strands forming the final strength member, and thus an even distribution of such fibers in the strength member itself. That is, in the known art, the different fibers forming the blend are sought to be evenly distributed throughout the strands forming the strength member as well as in the strength member itself, in accordance with their blend ratio, and not have a concentration of one fiber type in one region of a strand forming the strength member and different fiber type concentrated at a different region of a strand forming the strength member. For example, if the blend ratio is 1:1, then any portion of the rope's strength member and/or of a strand forming the rope's strength member, when randomly selected, should upon inspection reveal an equal or very near to equal quantity of the ARAMID fibers in comparison to the HMPE fiber. For another example, if the blend ration is 3:2 in favor of more ARAMID fibers in comparison to HMPE fibers, then any portion of the rope's strength member and/or of a strand forming the rope's strength member, when randomly selected, is likely upon inspection to reveal a 3:2 ratio of the ARAMID fibers in comparison to the HMPE fibers, or very near to such 3:2 ratio. Furthermore, it is the state of the art and the trend in the industry that when forming blended ropes of a combination of ARAMID fibers and HMPE fibers that the ARAMID and HMPE fibers are first blended together to form a yarn and/or a bundle, and then multiple of such yarns and/or bundles are themselves combined to form a strand that is then usually used with multiple similarly constructed strands to form the final strength member, either by twisting, braiding or other. The known art teaches that the count of ARAMID fibers to HMPE fibers, that is, the blend ratio of ARAMID fibers to HMPE fibers forming each of the main strands that form the ropes final strength member preferably is 50:50. However, other ranges are taught, for example ranges of 60:40 to 40:60, and even ranges of 80:20 are taught in, for example, U.S. Pat. No. 8,109,072.

However, as of yet, none of the known art has proposed a blended rope that provides a solution to the problem of bend fatigue induced destruction of high-strength fiber synthetic fiber strength membered ropes used in applications with high-tension blocks, such as crane ropes and other.

Other proposed solutions to the instant discussed problem rely upon mechanical processes for treating ropes formed with high-strength synthetic fibers such as HMPE or ARAMID fibers so as to make the ropes more tolerant of dynamic high-tension applications.

WO 2004/020732 A2 discloses a production process for forming a compacted and pre-stretched rope that was expected to solve the instant discussed problem. It was anticipated that by compacting the strength member that there would be minimal movement between its fibers, thus minimizing the internal friction, thus minimizing internal heat energy generation and accumulation. It was also expected that by pre-stretching the strength member, that more of the fibers in the final rope product would take strain, thus reducing the load per fiber and minimizing bend fatigue. However, in practice, ropes formed according to this publication's teachings have only been successful in applications where the rope is usually used well below its rated working load and where the periods of time requiring constant bending with constant travelling under tensions are minimal, and thus the rope has time to cool, such as in trawler warps. However, in applications such as crane ropes, where the strain on the rope is high for prolonged periods of time, and where the bending and travelling is for sustained periods, these ropes have failed to be successful and have not been adopted as crane ropes and in other applications requiring a combination of sustained periods of time with constant travelling and constant bending while under high tensions. Thus, the teachings of WO 2004/020732 A2 are considered by the industry to be unsuited for the instant discussed application and to not provide a workable solution to the instant discussed problem.

WO 2011/027367 A2 discloses production methods and a rope that includes and builds upon the teachings and the production method of WO 2004/020732 A2 with additional process steps and additional structure that were expected to enhance the service life of ropes for use in the instant application. WO 2011/027367 A2 memorializes and teaches that the teachings of WO 2004/020732 A2, which discloses that its teachings are applicable to ARAMID fibers, are in fact not suitable with ARAMID fibers, and discloses and memorializes that the teachings of WO 2004/020732 A2 are suitable only with fibers that can be creeped, and ARAMID fibers cannot be creeped. WO 2011/027367 A2 anticipates that its teachings would solve the instant problem using fibers that can be creeped in combination with its novel teachings. However, while the teachings of WO 2011/027367 A2 do indeed enhance the service life of a rope and have been successful for various applications, such as trawler warp applications, where the periods of time requiring constant bending with constant travelling under tensions at or exceeding the ropes rated working load are minimal, and thus the rope has time to cool, these successes have been largely limited to strength members formed from HMPE fibers and have failed to be successful as crane ropes and in other applications requiring a combination of sustained periods of time with constant travelling and constant bending while under high tensions, as the heat energy accumulation in these applications continued to create excessively rapid rope destruction with the low heat tolerant HMPE fibers. In practice, the teachings of WO 2011/027367 A2 have not provided for a crane rope and are considered by the industry to be unsuited for the instant discussed application and to not be a workable solution to the instant discussed problem.

Therefore, it is apparent that it is a widely held belief in the industry that ropes formed according to the teachings of both WO 2004/020732 A2 and WO 2011/027367 A2 are not satisfactory for many heavy lifting rope applications, e.g. as high-strength synthetic strength membered ropes suitable for substituting steel wire rope for use on sheaves, drums and winches where portions of the length of the rope are constantly travelling and bending while under tensions. In fact, it is clear that the state of the art and the trend in the industry steers the skilled worker away from a rope structure formed by the process teachings of both WO 2004/020732 A2 and WO 2011/027367 A2 and according to the teachings of both WO 2004/020732 A2 and WO 2011/027367 A2 when attempting to solve the long felt need in the industry described supra and for which the present disclosure seeks to put forth a solution.

It thus also can be appreciated that it is the widely held belief in the industry that HMPE fibers are absolutely unsuitable for any application where it already is known that a synthetic strength membered rope is unsuitable in comparison to wire rope due to heat fatigue and/or due to bending fatigue, and in fact the use of HMPE fibers in such an application is widely held by the industry to not be feasible.

TEFLON (PTFE) fibers also have failed to be successfully used in solving the problem sought to be solved by the instant disclosure, mainly due to their poor tensile forces and fragility, with ropes formed of PTFE fibers being absolutely incapable of tolerating the needed stresses. It thus also can be appreciated that it is the widely held belief in the industry that PTFE fibers are absolutely unsuitable for any application where it already is known that a synthetic strength membered rope is unsuitable in comparison to wire rope due to heat fatigue and/or due to bending fatigue, and in fact the use of PTFE fibers in such an application is widely held by the industry to not be feasible.

Various other attempts are known to reduce the internal friction within high-strength synthetic strength membered rope's and its concurrent destructive heat energy generation and accumulation. These attempts include situating lubricative coatings and impregnation agents among and between fibers, yarns and strands forming the strength members. These lubricants and impregnation agents can be applied as liquids and semi-liquids and remain in liquid form, semi-liquid form, solid form and matrix form. These teachings are included with the otherwise novel disclosures of WO 2004/020732 A2 and WO 2011/027367 A2 mentioned above.

US 20140069074 proposes coating strands formed from high-strength fibers with a liquid coating, and subsequently forming the coated strands into a strength member for use in a rope. Many teachings are well known for using lubricative substances to coat strands, and to coat individual fibers and yarns forming strands, and to form strength members with strands having such lubricative coatings. It is the wisdom in the industry that the goal of such lubricative coatings is to prevent and minimize internal friction and thus to prevent and minimize rope damage caused by the internal friction. Nonetheless, these solutions have failed to provide a solution to the problem described supra and for which the present disclosure seeks to provide a solution.

That is, as of yet, none of the known art has proposed a working solution to the problem of bend fatigue induced destruction of high-strength fiber synthetic strength membered ropes.

A partial solution to this problem and one that has been widely adopted into the industry is to form a combination strength member by connecting a length of high strength synthetic strength member to a length of a strength member formed either of steel wire rope or of chain, and then to use the combination strength member in such a way that only the metallic strength member is in contact with the blocks and sheaves, while the synthetic strength member is serving only as a light weight and very strong tension bearing strength member, usually suspending in water, without travelling over blocks, depending upon the application. A serious problem with this partial solution to the problem is that the steel wire rope and/or the chain is under high tension and when any portion of the combination strength member unexpectedly ruptures there occurs the dangerous and sometimes deadly recoil described supra.

Another partial solution to this problem has been to constantly pour cold water onto the blocks and/or sheaves about which is wrapped and deployed a high strength synthetic strength membered rope. The goal is to cool the rope and thus prevent the heat induced destruction of the synthetic strength member. However, this partial solution is not effective as the economic cost of cooling the amount of water required for such solution has proved prohibitive, and it is not always possible to deploy the equipment and water required for such partial solution. This partial solution has not been widely adopted by the industry.

Further exacerbating this problem is that high-strength synthetic strength members are easily abraded and quickly destroyed by abrasion in comparison to steel wire rope strength members, and especially by contact with the surfaces of drums, winches and sheaves while under tension, and consequently are sheathed so as to prevent damage to the synthetic strength member. A drawback to the sheaths is that they prevent dissipation of the above described heat energy generated interior the strength member, and continue to do so even when cold water is poured onto the rope, resulting in accelerated destruction of the strength member and a concurrent reduction in its service life.

It therefore can be appreciated that it is a widely held belief in the industry as well as the state of the art and the trend in the industry that sheathing of a high-strength synthetic fiber rope used with high tension blocks is an impediment to dissipation of the destructive heat energy accumulating within the strength member. It therefore can be appreciated that it is a widely held belief in the industry and a trend in the industry that the amount of sheathing material must be minimized when forming a high-strength synthetic strength membered rope for use with high tension blocks.

In more detail about WO 2004/020732 A2 and WO 2011/027367 A2 and other exemplary attempts to solve the long felt need in the industry:

WO 2004/020732 discloses a method for forming an ultra-high strength and light weight rope that also compacts and pre-stretches the rope. This publication anticipates that its teachings are applicable to ARAMID fibers. However, while these teachings have proved highly successful for producing ropes where internal friction caused heat energy accumulation and heat energy caused destruction of the rope's strength member is NOT a concern, which is where portions of the length of the rope need not be capable of sustained periods of constant travel and bending under high tensions, in practice these teachings have failed to produce either an ARAMID or a other high-strength synthetic fiber strength membered rope for applications where high internal friction and its resultant bend fatigue induced heat failure is a concern, such as for example crane ropes.

WO 2011/027367 A2, that is a much later publication than is WO 2004/020732 A2, discloses a method and construction for adhering a sheath to a synthetic strength member formed according to teachings of WO 2004/020732 A2 so as to make the rope longer lived when used with powered blocks and explains and memorializes that the teachings of WO 2004/020732 A2 have surprisingly and unexpectedly been found to only apply to fibers that can be creeped, such as HMPE fibers. ARAMID fibers are not fibers that can be creeped, and, as WO 2011/027367 A2 discloses, ARAMID fibers are not useful for and with the disclosures and teachings of either WO 2004/020732 A2 or with its own disclosures. Therefore, it is clear that WO 2011/027367 A2 steers the skilled worker away from attempting to use the production methods of either WO 2011/027367 A2 or WO 2004/020732 A2 to form with ARAMID fibers a rope that solves the long felt need in the industry described supra, as this publication discloses that ARAMID fibers are unsuitable for forming ropes according to the teachings of both of these two publications.

US 20140069074 is a publication that also is later than WO 2004/020732 A2 and discloses a method of producing a rope with ARAMID fibers for the rope's strength member where individual strands forming the strength member are formed of ARAMID fibers and subsequently coated with a liquid synthetic substance prior to using the coated ARAMID strands to form the strength member. However, in practice, experimentation has verified that ARAMID strength membered ropes produced in accordance with the disclosures and teachings of this publication (US 20140069074) are unable to tolerate the internal friction and bend fatigue generated heat energy associated with use on high tension drums and winches where the rope must be capable of sustained periods where portions of the length of the rope are constantly travelling and bending at high tensions and such ropes have not been successfully adopted into industry, for example, as crane ropes.

Furthermore, in practice, experimentation has proven that teachings of this publication (e.g. US 20140069074) when combined with the teachings of either or both WO 2011/027367 A2 or WO 2004/020732 also fail to produce a rope suitable for use with high tension powered blocks where the rope must be capable of sustained periods where portions of the length of the rope are constantly travelling and bending at high tensions. Furthermore, experimentation has shown that no strength member formed in accordance with this publication's (US 20140069074) teachings when further subjected to compacting processes taught in either or both WO 2011/027367 A2 and WO 2004/020732 A2 can produce an ARAMID strength membered rope suitable for use with high tension powered blocks where the rope must be capable of sustained periods where portions of the length of the rope are constantly travelling and bending at high tensions.

It is thus evident that the teachings of WO 2004/020732 A2, WO 2011/027367 A2 and US 20140069074 do not in any combination guide the skilled artist to a solution for how to produce a crane rope with an ARAMID or other synthetic fiber strength member or to a solution for how to produce an ARAMID or other synthetic fiber strength membered rope that is useful in applications where the rope is used with high tensions powered blocks where the rope must be capable of sustained periods where portions of the length of the rope are constantly travelling and bending at high tensions. That is to say, none of these publications, separate or in combination, has provided workable solution to the problem described supra.

In fact, none of the known art has provided a workable solution to the problem described supra.

As of yet none of the known art has proposed a working solution to the instant discussed problem.

Due to the lack of a working solution to this problem, steel wire rope continues to be used in applications such as lifting applications, crane rope and other uses with high tension blocks, with continuing loss of life and limb.

Thus, it can be appreciated that a long felt need exists in the industry and continues to exist in the industry for a high-strength synthetic fiber strength membered rope that has an extended service life in comparison to known high-strength synthetic fiber strength membered ropes, and preferably as long a service life when used on high tension drums, winches and sheaves as does steel wire rope and especially for applications that require a combination of constant travelling and constant bending on blocks and sheaves while under high tensions and strain, such as crane ropes.

As of yet, none of the known art has proposed a rope construction or a rope production process that discloses a proportional arrangement for a combination of various materials as taught in the present disclosure. As disclosed further herein and below, the proportional arrangement of the various combined materials of the present disclosure when combined with a production process for arranging such materials addresses the above described need long felt in the industry.

It is a goal of the present disclosure to provide both a construction for and a process for production of a rope that address the needs long felt in the industry for a rope formed with a strength member formed of high-strength synthetic fibers, where such strength member is enclosed in a fiber sheath, where such rope is suitable for use with drums, winches, blocks and sheaves where portions of the length of the rope are constantly travelling and bending at high tensions.

Definitions

For the purposes of the present disclosure, a high-tension drum and/or winch is a powered drum and/or winch that is capable of applying to a rope more than five tonnes of tension and up to several thousand tonnes of tension.

For the purposes of the present disclosure, a high-tension sheave is a sheave and/or block that is capable of being used with a rope on it where the rope is capable of being loaded to more than five tonnes of tension and up to several thousand tonnes of tension.

For the purposes of the present disclosure, a high tension powered block and/or a high-tension block is a high-tension drum, winch, sheave, capstan or the like.

For purposes of the present disclosure, high tension means tensions typically applied to ropes as acceptable working loads according to industry standards for acceptable working loads, and includes tensions greater than 15% of the ropes maximal tensile force. (Note: As these are very strong ropes designed to substitute steel wire rope, their working loads tend to be very high.)

For purposes of the present disclosure, a large diameter rope is a rope having a diameter of ten millimeters or more.

Disclosure

It is an object of the present disclosure to provide for a high strength blended synthetic strength member containing rope for use with high-tension blocks that addresses the above stated long felt need in the industry.

It is yet another object of the present disclosure to provide for a high strength blended synthetic strength member containing rope capable of being used with high-tension blocks that exhibits improved service life and especially that has improved tolerance to constant bending over high-tension blocks and sheaves in comparison to known synthetic strength member containing ropes.

It is yet another object of the present disclosure to provide for a high strength blended synthetic strength member containing rope capable of being used with high-tension blocks and satisfying the above stated objects of the present disclosure where such rope is capable of being used in substitution of steel wire rope for applications including but not limited to crane ropes, deep sea deployment and recovery ropes, trawl warps, anchoring lines, seismic lines, oil derrick anchoring and mooring lines, tow ropes, towing warps, deep sea lowering and lifting ropes, powered block rigged mooring ropes, powered block rigged oil derrick anchoring ropes used with blocks and also with powered blocks, superwides and paravane lines used in seismic surveillance including but not limited to being used with towed arrays, yachting ropes, rigging ropes for pleasure craft including but not limited to sail craft, running rigging, powered block rigged anchor ropes, drag lines, climbing ropes, pulling lines and the like.

Disclosed is a method for producing a blended high-strength synthetic fiber strength member rope capable of being used with high tension blocks including high tension powered blocks, and the rope product resultant of such method, where such rope has lighter weight and similar or greater strength than steel wire strength member containing ropes used with high-tension blocks, and where also such rope has, in comparison to known synthetic strength member containing ropes including blended synthetic strength member ropes, a longer service life especially when used with high-tension blocks.

Description

Most broadly, the present disclosure is based upon the surprising and unexpected discovery that a highly bend fatigue resistant rope having a high strength synthetic strength member can be achieved by forming a braided strength member from multiple strands where individual of said strands are formed of a blend of ARAMID fibers in combination with HMPE (including UHMWPE) fibers, in a certain fashion and construction not previously taught; and, subsequently, processing the strength member formed of such fibers according to methods known not to be useful with strength members formed of either ARAMID fibers or HMPE fibers for purpose of forming rope strength members for the instant rope application, and especially with methods already known to fail when used with ARAMID fibers and/or HMPE fibers, for forming strength members for ropes of the instant rope application to, surprisingly, unexpectedly, contrary to the state of the art and against the trend in the industry, obtain a rope having improved service life when used with high tension blocks where the rope must tolerate sustained periods of time combining constant bending and high tension, such as a crane rope.

Broadly, the bend fatigue tolerant synthetic rope of the present disclosure is based upon the surprising and unexpected discovery that by forming a blended strength member from multiple main rope strands each having a core that is formed mainly and preferably entirely of ARAMID fiber; and, further, having at the outer periphery of each such strand a concentration of HMPE fibers, as is contrary to the state of the art and trend in the industry that dictates an homogeneous distribution of HMPE and ARAMID when forming a blended strand of same, and where the HMPE portion is preferably formed as a sheath layer of HMPE fibers about the ARAMID portion of each such strand, where, further contrary to the state of the art and against the trend in the industry, such sheath is formed in a fashion considered too loose by industry standards for a sheath designed primarily to protect an enclosed synthetic fiber strength member from abrasion and/or wear, as is contrary to the state of the art and against the trend in the industry; and, further, by subsequently producing a braided strength member by braiding together multiple of such main rope strands and subsequently and next processing the braided strength member formed of multiple of such main rope strands according to known teachings for permanently compacting and permanently elongating strength members formed of fibers that can be creeped and especially HMPE fibers, that are processes and methods explicitly known and explicitly taught in the industry to not be applicable for use with strength members formed from ARAMID fibers, as is contrary to the state of the art and against the trend in the industry; so as to permanently elongate and permanently compact the strength member for the rope, and, subsequently ensheathing the permanently elongated and permanently compacted strength member with an exterior sheath according to known standards, that, surprisingly and unexpectedly, a highly bend fatigue resistant synthetic strength membered rope useful for crane ropes and other applications involving high tension blocks is achieved.

Most preferably, and contrary to the state of the art and trend in the industry for forming blended high-strength fiber ropes from ARAMID and HMPE fibers, in each of the main rope strands forming the final braided strength member for the rope, the HMPE fibers have a fundamentally different cross-sectional shape than do the ARAMID fibers, and the HMPE fibers preferably are formed as a film or a tape.

Most preferably, and also contrary to the state of the art and against the trend in the industry for forming blended strength members of a combination of HMPE fibers with ARAMID fibers, the ratio of ARAMID to HMPE in each main rope strand used in forming the final braided strength member is greater than ninety percent by weight ARAMID to HMPE, e.g. greater than 90:10, and certainly greater than eighty percent by weight ARAMID to HMPE, e.g. greater than 80:20. More preferably such ratio is greater than 97:3.

The HMPE fibers in a distinct main rope strand preferably are situated at the outer periphery of an ARAMID core and retained in such region by being arranged as a sheath about the ARAMID core (the term "distinct" herein including "individual"). This way, there is no risk that the HMPE fibers shall be dislodged to a different region of the main rope strand such as becoming intermingled with the ARAMID core. Contrary to the state of the art and the trend in the industry for forming sheaths about high-strength fiber cores, the HMPE sheaths of the present disclosure preferably are formed as thin as possible considering what is possible with current technology. When the sheaths are formed as braided sheaths, the braid angle for the braided sheaths is selected as longer than what is considered by those skilled in the art to be acceptable for outer sheaths designed to protect synthetic high-strength fiber cores from abrasion and/or wear. That is, the braid angle of the sheath is more approaching parallel to the long axis of a main roe strand in comparison to what is considered optimal and/or acceptable by the skilled worker.

Preferably, and importantly, the constrictive force applied by most and preferably by any primary strand sheath to the Aramdid core strand that it encloses is both as tight as possible, and especially sufficiently tight that it prevents, and at least that it reduces, relative movement between ARAMID fibers forming each core strand; and, also being such that the ARAMID core strand loses its circular and/or original cross section when used to form a braided rope by being braided in hollow braid configuration with other ARAMID core strands that are themselves enclosed by a primary strand sheath, and then heated and permanently elongated as taught herein.

Most preferably, and importantly, the heating and stretching is done in such a way as to include selecting both a heat and a tension that results in sufficient constrictive force generated by the elongation of the hollow braid structure of the strength member so that in the final permanently elongated strength member each core ARAMID strand that is enclosed by a primary strand sheath (that preferably is all of the primary rope strands), lacks either a circular or an oval cross sectional shape in the final produced rope, when taken at a random cross sectional view along the length of the rope and in plane perpendicular to the long axis of the rope.

Preferably, each primary strand sheath enclosing each core strand is formed as a braided sheath, and, preferably, using a fiber that has a fundamentally different cross-sectional shape in comparison to the ARAMID fibers forming each core strand. Particularly preferred for the fibers forming the sheaths that enclose the core strands are HMPE fibers having a flattened cross-sectional shape, and preferably HMPE fibers that are a film. Endumax is a useful HMPE film for forming the sheaths that enclose the core strands formed of ARAMID. A presently preferred ARAMID is Twaron. Although TEFLON fibers and Polyester fibers can be used for forming the fibers and/or tape and/or film forming the sheaths that enclose the core strands, contrary to our prior teachings in WO 2017/199267 A1, we have found that HMPE is highly preferred. HMPE tape can be used to make the sheaths enclosing the core strands by wrapping the tape around the core strand, such as with 20% to 50% overlap, or with an even greater overlap. Again, although TEFLON tape and Polyester tape can be used in such construction, we have found, contrary to our prior teachings in WO 2017/199267 A1, HMPE is presently more preferred than TEFLON and/or Polyester for fibers and tapes for forming the sheaths enclosing each core strand with either a braided sheath or a wrapped tape, and, surprisingly and unexpectedly, the use of HMPE in this way increases the longevity of the rope, the service life of the rope, and the bend fatigue resistance of the rope more in comparison to using TEFLON and/or Polyester for fibers and tapes for forming the sheaths enclosing each core strand with either a braided sheath or a wrapped tape.

A presently most preferred process and construction for the sheaths enclosing each core strand is to form the sheath of multiple individual film shaped fibers of HMPE that are braided around each core strand using a hollow braid construction. Although a braid construction and machinery that results in the film type HMPE fibers being rotated about their own long axis as they are spun about the core strand while being women into the sheath around each core strands is useful, a braid construction that does not rotate the film like fibers about their long axis is presently preferred. Most preferably, each braid strand forming such braided sheath surrounding a strand formed of ARAMID fibers, using known machinery, is a single film type fiber of HMPE. An example of such a film fiber is Endumax.

Preferably, the film shaped HMPE strands forming each hollow braided sheath do not rotate or twist about their own long axis, but rather are untwisted about their own long axis.

An advantage of the disclosed blended synthetic rope for high-tension blocks is that it has greater tolerance to bending fatigue and greater service life in comparison to known synthetic ropes for high-tension blocks where the rope must tolerate sustained periods of constant tension while travelling and bending about blocks, such as crane ropes, thus reducing the long term costs to use the rope, thus promoting use of such ropes in environments where such ropes are known as being more safe for operators and crew, as discussed above.

Another advantage of the disclosed blended synthetic rope for high-tension blocks is that it has improved predictability of the maximum safe service life of the rope.

Possessing the preceding advantages, the disclosed bend fatigue resistant synthetic rope for high-tension blocks answers needs long felt in the industry as it is a longer-lived synthetic rope for crane ropes and for powered blocks in comparison to known synthetic ropes.

It can readily be appreciated that these and other features, objects and advantages are able to be understood or apparent to those of ordinary skill in the art from the following detailed description of the preferred embodiment including as illustrated in the various drawing figures.

BEST MODE FOR CARRYING OUT THE DISCLOSURE

Figure 1:
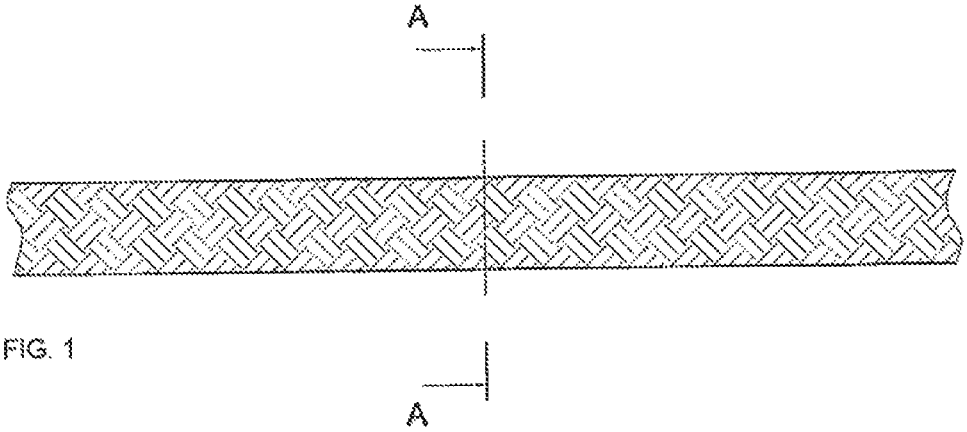
FIG. 1 is a plan view of a portion of a rope of the present disclosure.
Figure 2:
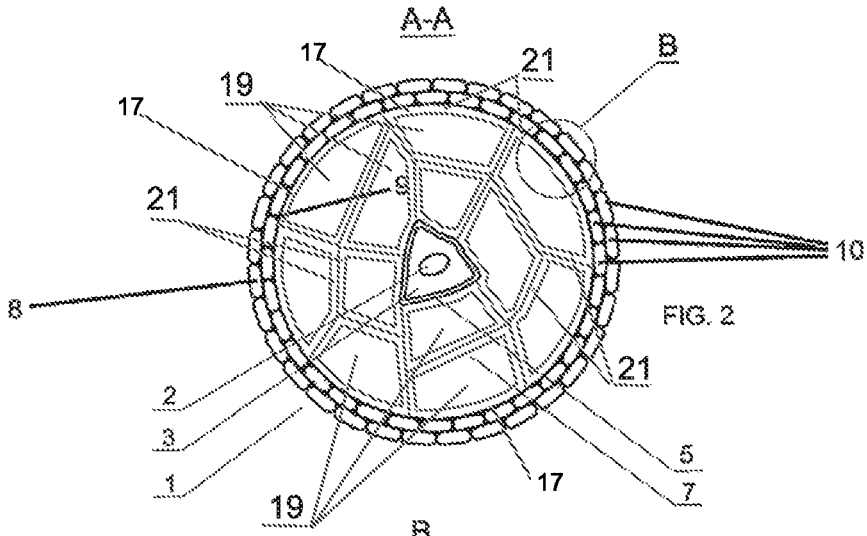
FIG. 2 is a view of a cross section of the rope of the present disclosure taken along line A-A of FIG. 1.
Figure 3:
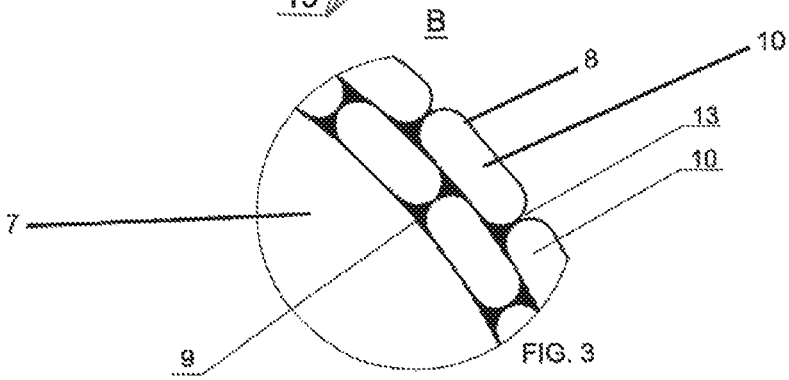
FIG. 3 is an expanded detail view of a portion of the cross section of the rope of the present disclosure shown in FIG. 2 that is indicated by reference character B. The expanded detailed view includes a braided outer sheath of the rope of the present disclosure, a portion of the strength member of the rope of the present disclosure where such portion of the strength member is proximal the braided outer sheath, as well as associated structures.

FIG. 2 and FIG. 3 illustrate essential constructional components of a preferred embodiment of the present disclosure's bend fatigue resistant blended rope for use with high tension blocks and powered blocks, and is identified by the general reference character 1. FIG. 2 depicts a preferably thermoplastic shaped supportive core 3 enclosing an optional core 2 that can be an elongatable conductive structure capable of transmitting information and/or data, such as may include a thermoplastic core having fiber optic conductors spiraling about it and encased within another layer of thermoplastic where the thermoplastic core and the another layer of thermoplastic are either the same type of thermoplastic or are types of thermoplastic that bond firmly to one another so as to be inseparable without damaging the entire structure that they form, and preferably that bond to the exterior surface of each of the fiber optic conductors or of the buffer or insulating that is exterior and formed about each of the fiber optic conductors, or that can be a lead core, or other, the shaped supportive core 3 being enveloped within a flow shield sheath 5. Strength member 7 encloses the combination of the shaped supportive core 3, its enveloping flow shield sheath 5 and its optional core 2. Contrary to the state of the art and against the trend in the industry, the blended high-strength synthetic strength member is formed of a non-heterogeneous blend of ARAMID and HMPE fibers, preferably by forming the blended strength member of several individual main rope strands 17 that themselves each are formed of a core 19 formed mainly and preferably entirely of ARAMID fibers, and further have a layer 21 formed mainly and preferably entirely of HMPE material situated about and around the outer periphery of the core.

Contrary to the state of the art and against the trend in the industry, the cores 19 preferably are formed by directly stranding the ARAMID fibers to form a strand, said such strand forming the cores 19, without use of yarns and/or bundles grouped together to form a core 19. Preferably, each layer 21 is in the form of a sheath 21 known as a primary strand sheath. The various individual main rope strands 17 preferably are of uniform construction, or of similar construction. Each of the individual ARAMID cores 19 preferably is enclosed within a distinct primary strand sheath 21 that preferably is a braided sheath formed of HMPE (including UHMWPE). In some embodiments, such as when using film shaped HMPE strands, preferably, each HMPE fiber may forms one of the braid strands forming each distinct braided primary strand sheath 21.

Exterior sheath 8 preferably is of a braided construction and is adhered to strength member 7 by an elastic adhesive substance layer 9, that preferably is formed of a settable adhesive substance such as an adhesive polyurethane having a high elasticity and a high shear strength, such as a two or more component PUR. Preferably braided exterior sheath 8 is formed of multiple braid strands 10 by use of a braiding machine, the braid strands 10 preferably are of a laid construction. Preferably, there are thirty-two individual strands 10 forming the overbraided exterior sheath 8, each strand 10 having between twenty-four to thirty-six fibers in each strand, preferably of an abrasion resilient construction, and, especially, of a different construction than primary strand sheaths 21, that are formed with a construction that is too loose by industry standards for a protective braided sheath about a synthetic strength member. The selection of the fiber and material type for protective exterior sheath 8 depends upon the application, with known useful fiber types including Kevlar, Polyester, and other, and also include HMPE fibers of non-tape like and non-film like shapes, but rather of usual circular or near circular or figure eight and/or side by side shapes. However, any quantity of strands 10 forming the overbraided exterior sheath 8 that provide sufficient wear resistance and strength transfer to the strength member 7 are useful, including but not limited to twenty-four, twenty-eight, thirty-six, forty-two, forty-eight, up to sixty-four and even much more. The braid tension on each strand 10 forming the exterior sheath 8 during braiding operations preferably is about sixty-three kilogram, and can be from forty to one hundred sixty kilograms. Importantly, the braid tension on each strand forming a braided primary strand sheath 21 during braiding operations of any such braided primary strand sheath 21 when a braided sheath variant is selected for the primary strand sheaths 21 is lesser per strand forming a braided sheath 21 in comparison to the braid tension used per strand 10 during braiding operations when forming the coverbraided exterior sheath 8. The braid tension on each strand forming a braided primary strand sheath 21 during braiding operations of any such braided primary strand sheath 21 is preferably about seven kilograms, and can be from ten grams to thirty kilograms, though optionally it is nine times less than the braid tension used per strand 10 during braiding operations when forming the coverbraided exterior sheath 8, and is at least forty percent less.

Optionally, and preferably, as shown in more easily visible detail in FIG. 3, elastic adhesive substance gap filling surface layer 13 fills in depressions on the surface of rope 1 formed in between adjacent coverbraid strands 10.

In order to form the rope of the present disclosure:

Preferred Fabrication Methods

There are two preferred embodiments of the present disclosure: one is a rope of the present disclosure for use in applications where the rope of the present disclosure is subject to storage under high compressive pressure, such as when used with high tension winches and drums, such as when used as a trawler's warp; another is where the rope of the present disclosure is not subject to storage under high compressive pressure, such as is common in many yachting applications.

In forming a preferred embodiment of the present disclosure for use in applications where the rope of the present disclosure is subject to storage under high compressive pressure:

First is provided a plurality of fibers that preferably are an ARAMID. An example of a presently preferred ARAMID fiber is Twaron, contrary to our prior disclosure. These fibers are used in forming several distinct strands that serve as the core strands 19. Preferably, a minimum of twelve distinct core strands 19 are formed, but a minimum of eighteen to twenty-four core strands is preferred for forming the strength member. Contrary to the state of the art and against the trend in the industry for forming blended ropes from high-strength fibers, the core strands 19 preferably are stranded directly from the ARAMID fibers without first stranding the ARAMID fibers into yarns and or bundles and then using those yarns and/or bundles to form strands to use in forming a blended rope. That is, direct stranding from ARAMID fibers presently is preferred for forming a core strand 19 for purposes of enacting the preferred embodiment of the present disclosure. The ARAMID fibers stranded directly together to form each core strand 19 are preferably loosely twisted together.

However, but not presently preferred, the process may be accomplished by first stranding the ARAMID fibers into yarns and or bundles and then using those yarns and/or bundles to form distinct core strands 19.

Second, optionally but preferably, after forming the several distinct core strands 19 from ARAMID fibers, the core strands are saturated with impregnations agents and/or lubricative agents using known processes and agents and so as to minimize the potential for friction between various of the ARAMID fibers forming each core strand 19.

Third, each of the distinct core strands 19 is wrapped by a distinct sheath 21, formed as already disclosed supra.

Thus, provided are several main rope strands 17 each formed of an ARAMID core strand 19 ensheathed by a HMPE sheath 21.

Fourth, next, several and preferably at least twelve, and more preferably at least eighteen to twenty-four already formed main rope strands 17 are used to form a braided strength member having a hollow braided construction that is achieved by using a braiding machine to braid together the main rope strands 17 about a flow shield 5 ensheathed thermoplastic rod that forms the core 3, where the main rope strands 17 are formed in a hollow braided construction about the flow shield ensheathed thermoplastic rod forming the core 3. Alternative to hollow braided, the strength member may be parallel laid, laid (including twisted) or plaited, but a hollow braided construction is strongly preferred. It is highly preferable and important for a preferred embodiment of the instant disclosure that a hollow braided strength member is selected that has a thermoplastic core having a sufficiently large diameter so that the core can be shaped during its molten phases in subsequent processing steps so as to fill out the natural interior cavity formed interior the hollow braided strength member under tension.

Preferably, for a strength member is provided a braided strength member where the main rope strands 17 forming the strength member have been stretched so as to remove constructional elongation and so as to cause permanent elongation and permanent compaction of the strength member and all contained within it, after the main rope strands 17 have been braided into the strength member, so that the resultant strength member is unable to elongate greater than 5% before reaching break point when measured at an original tension of 100 Kg, and preferably so that the resultant strength member is unable to elongate greater than 3.5% before reaching break point when measured at an original tension of 100 Kg. In order to form such an embodiment of the present invention, that is in forming a strength member for the preferred form of the instant disclosure the following further steps are employed:

First: a thermoplastic elongate object and especially a core formed of Polyethylene is provided, e.g. a PE rod, that ultimately forms core 3.

Second: a flow shield 5 is formed about the thermoplastic rod 3. A preferred fashion to accomplish this is by braiding a tightly woven braided flow-shield sheath 5 around the thermoplastic rod 3. Filaments are selected to form the flow-shield sheath that are not made either liquid or semi-liquid at a temperature selected to change the phase of the thermoplastic rod, but rather that have a much higher softening point than the material of the thermoplastic rod. Polyester is suitable.

Third: the main rope strands 17 are loaded onto bobbins that are loaded onto cars of a braided machine capable of forming hollow braids and are braided around the thermoplastic rod surrounded by a flow-shield sheath, so as to form a hollow braided strength member including a thermoplastic core surrounded by a flow-shield sheath.

Fourth: the braided strength member having the thermoplastic rod surrounded by the flow-shield sheath as its core is then subject to tension and to heat, preferably by being subject first to tension and secondly to heat, while maintaining the tension, in such a fashion and under such conditions that the thermoplastic selected to form the thermoplastic core becomes semi-liquid, i.e. molten, at a temperature that is used to permanently elongate the braided strength member by applying about thirteen percent of the cool strength member's breaking force to the heated strength member. The flow shield-sheath 5 mainly or entirely stops the phase changed thermoplastic core from exiting the flow-shield sheath. That is, the majority of the thermoplastic core is unable to exit the flow-shield sheath even when the thermoplastic core is either liquid or semi-liquid, i.e. molten, despite enormous constrictive and compressive forces applied to the phase changed thermoplastic core as a result of the high tensions applied to the strength member, such high tensions able to permanently elongate the strength member under the conditions taught supra and herein.

A preferred tension to be used in the disclosed processes for forming the disclosed rope is about thirteen to fifteen percent (13-15%) of the break strength of the strength member when such break strength is measured at room temperature, with up to twenty-two percent being useful, and in some cases even more.

Importantly, the tension applied to the strength member, and thus necessarily also applied to the filaments forming the strength member, preferably is a static tension and/or a generally static tension and/or a very slowly fluctuating tension. After applying a predetermined tension (including approximately a predetermined tension), and while under such predetermined tension simultaneously the strength member, its filaments, and its thermoplastic core are heated to a predetermined temperature and/or to approximately a predetermined temperature as taught above and herein, with a minimum temperature of eighty (80) degrees C. being most preferred. Next, another tension may be applied to the strength member that is selected so as to permanently elongate the strength member a desired amount and also so as to permanently compact, e.g. cause a reduction in overall diameter of the strength member, to a desired amount, that also are amounts that reduce the capacity for ARAMID fibers forming the primary rope strands to move relative to one another.

Fifth; when the braided strength member and its thermoplastic core and the thermoplastic core's flow shield have been elongated and compacted to predetermined amounts so as to create an ultra-compact rope, and to experience a reduction in overall exterior diameter of the rope of at least three percent, and also of at least fifteen percent, and also of from fifteen to thirty and up to forty-five percent in comparison to the rope's overall exterior diameter prior to the stretching and heat processing steps, the now elongated strength member and its elongated thermoplastic core are cooled while sufficient tension is maintained and applied to the strength member and thus by extension to its thermoplastic core 3 and other components during the cooling process so that all such components are cooled to their respective solid states while under a tension that results in the cooled main rope strands 17 formed from the core strands 19 as well as the cooled distinct primary strand sheaths 21 enclosing the core strands 19, as well as the strength member and its flow shield enclosed thermoplastic core 3 being permanently elongated, and the strength member being permanently compacted, and the thermoplastic core being permanently deformed to adapt to and, most preferably, so as to both adapt to and completely fill out the natural interior cavity of the hollow braided strength member 7 that is exhibited when the final formed strength member is under tension. The thermoplastic rod 3 is selected of sufficient diameter and bulk so as to permit so filling out the natural interior cavity of the strength member under tension. That is, the thermoplastic core is reshaped during the production process described supra so that the thermoplastic core supports the main rope strands 17 in their ideal positions, preventing them from being displaced by crushing forces incurred on high tension blocks, by being selected of sufficient diameter and bulk to permit filling out the needed interior cavity of the strength member being formed, and by being first changed in phase from solid to molten state, and retaining in molten state while the strength member is permanently elongated and permanently compacted, and by having the strength member retained under tension, that is, subject to strain, while cooling the strength member and also the thermoplastic core so that it returns to its solid phase while the strength member is maintained at sufficient tension to retain the desired amount of permanent elongation. This process causes the strength member to:

a) to acquire a lower capacity for elongation than it had prior to its having been permanently elongated and permanently compacted, and prior to having had its thermoplastic core adapted to fill the strength members internal cavity;

b) to acquire a substantially lesser diameter and a greater compactness than it had prior to its having been permanently elongated and permanently compacted;

c) to result in less capability for relative movement between ARAMID fibers forming the primary rope strands; and d) to acquire to its thermoplastic content core a permanent solid shape, having at its surface the flow shield sheath also taking the same shape as the exterior of the core, that supports the interior cavity of the permanently elongated hollow braided strength member in such a fashion that the filaments and braid strands forming the strength member are sufficiently less able to move relative to one another in a direction perpendicular to the long dimension of the permanently elongated strength member in comparison to prior to the strength member having been permanently elongated so as to reduce filament to filament abrasive wear, and also so as to preclude crushing of the rope, especially under high compressive forces such as occurs during reeling/winding upon and storage on a high tension drum, the necessary tension to achieve such result for any particular LCP and HMPE blend formed according to the present disclosures teachings able to further be experimentally determined by one of ordinary skill in the art after having read the present disclosure.

Surprisingly and unexpectedly, and directly contrary to the explicit teachings and state of the art and trend in the industry, the blended strength member of the present disclosure benefits from the above described production process as disclosed above despite the fact that its main rope strands are formed mainly from ARAMID fibers.

Sixth; optionally, and preferably, an elastic adhesive substance, especially a two or more component polyurethane blend, is used to adhere the formed strength member to an exterior braided sheath 8. The elastic adhesive substance is chosen as a flowable settable adhesive substance. While it is in a liquid and/or semi-liquid (including "flowable") phase, it is situated upon the outside surface of the preferably permanently elongated strength member, in contact with surfaces of multiple of the distinct primary strand sheaths 21. Then a preferably braided exterior sheath 8 is formed about the combination of the permanently elongated strength member and the flowable settable adhesive substance, still in its flowable phase.

The final formed and final processed strength member preferably has the elastic adhesive substance situated exterior the itself just prior to the exterior sheath 8 being braided about the strength member.

Examples of the Present Disclosure:

1. A synthetic fiber rope capable of being used in application with high tension blocks, i.e. in an application requiring bending around high tension blocks while being subjected to strain, that can also include travelling while simultaneously bending around high tension blocks while being subject to strain, the rope having an outer sheath (8) enclosing at least a strength member (7), the strength member (7) being a blended strength member (7) comprising: (i) ARAMID fibers; and (ii) HMPE fibers, the blended strength member comprising main rope strands (17), at least most and preferably all of the main rope strands (17) each comprising: (a) a core (19) formed mainly and preferably entirely of: (i) ARAMID fibers; and (b) a structure (21) that mainly is situated about and around the outer periphery of each said core (19) and that is formed mainly and preferably entirely of HMPE.

2. The synthetic fiber rope of example 1 comprising a braided strength member formed of multiple main rope strands (17) where most and preferably each of said multiple main rope strands (17) are further characterized by the fact that: (i) mainly and preferably entirely ARAMID fibers form the fiber quotient of said strands' cores (19); and (ii) each said structure (21) that is situated about and around the outer periphery of each of said strands' cores (19) also mainly is situated at the outer periphery of the main rope strand (17) with which is associated the structure (21).

3. The rope of examples 1 or 2 where the structure (21) of a most and preferably each of said main rope strands (17) is formed as a sheath (21) of fibers HMPE fiber, and is situated about its associated core (19) and where its associated core (19) is formed of ARAMID fibers.

4. The rope of any one of examples 1 to 3 wherein the weight ratio in the strength member (7) of ARAMID fibers relative to HMPE in the strength member (7), is at minimum 80:20.

5. The rope of claim 5 wherein the weight ratio is at minimum 90:10 and more preferably a minimum of 97:3.

6. The rope of example 5 where most and preferably each sheath (21) is formed as a hollow braided sheath formed of braid strands.

7. The rope of example 6 where most and preferably all braid strands forming most and preferably each hollow braided sheath (21) are a filament of HMPE film.

8. The rope of any one of examples 4 to 7 where the fibers forming most and preferably each core (19) are ARAMID fibers that are Twaron fiber, and where the ARAMID fibers have a different cross section than the cross section of the material formed mainly and preferably entirely of HMPE forming the sheath (21), where HMPE film fibers form the sheath (21).

9. The rope of any of examples 5 to 8 where most and preferably all the core portions (19) are formed mainly of ARAMID fibers, and preferably of Twaron fibers, and where most and preferably all the core portions (19) as well as the sheaths (21) associated with the core portions (19) have cross-sectional shapes when viewed in a plane that is perpendicular to the long axis of any of (i) a main rope strand (17); or (ii) the strength member (7), where the cross sectional shapes do not define a circular shape.

10. The rope of example 9 where the cross-sectional shapes do not define either an ellipse or an oval.

11. The rope of any one of claims 8 to 10 where the film shaped strands forming each hollow braided sheath (21) do not rotate or twist about their own long axis for at least lengths of the strength member (7) that are greater than twenty centimeters in length and preferably for lengths extending the full length of the strength member.

12. The rope of any one of examples 1 to 11 where most and preferably each core portion (19) lacks yarns.

13. A process for producing a rope having a blended strength member, the process having at least steps of:

First: providing a thermoplastic elongate object (3) and especially a core (3) formed of PE and preferably formed as a PE rod;

Second: forming a flow-shield sheath (5) around the thermoplastic rod (3);

Third: forming several strands (17) where each strand includes ARAMID fibers; and (ii) a material formed mainly and preferably entirely of HMPE;

Fourth: loading a braiding machine capable of forming a hollow braided sheath with at least several of the strands (17) from the third step, and using the loaded braiding machine to form a hollow braided strength member (7) about the combination of at least the thermoplastic core (3) and its associated flow-shield sheath (5);

Fifth: subjecting the braided strength member (7) enclosing the thermoplastic core (3) that is sheathed within the flow-shield sheath (5) to tension and to heat, preferably by first subjecting the strength member (7) to tension and, secondly, by subjecting it to a heat suitable to change the phase of the thermoplastic core (3) to a semi-liquid phase, while choosing tension that may be either constant or variable and that at least at some point during application of tension is sufficient to permanently elongate and permanently compact the strength member;

Sixth: determining that a desired amount of elongation as well as desired amount of compaction of the strength member all contained within it has occurred, followed by subsequently, while maintaining tension sufficiently to preserve a desired amount of elongation and compaction of the strength member, cooling the strength member and all it contains at least until the thermoplastic core achieves a solid phase, the process comprising a step of selecting to form the strands (17) as (a) a core (19) formed mainly and preferably entirely of ARAMID fibers; and (b) a structure (21) that is mainly situated about and around the outer periphery of said core (19) and that is formed mainly and preferably entirely of HMPE.

14. The process of example 13 further comprising selecting to form most and preferably each of the strands (17) with proportionally greater quantities of the ARAMID fibers in comparison to the quantity of material formed mainly and preferably entirely of HMPE.

15. The process of any one of examples 13 or 14 further comprising selecting to form the structure (21) as a layer situated about the exterior periphery of its associated core (19).

16. The process of example 15 further comprising forming most and preferably each layer (21) as a braided sheath sufficiently tight that it reduces relative movement of ARAMID fibers forming its associated core (19), and also so that any such core (19) as well as any such sheath (21) are subsequently permanently deformed during the permanent elongation and compaction steps, and so as to adopt a cross sectional shape being none of circular, oval or elliptical.

17. The process of example 16 further comprising forming most and preferably each layer (21) as a sheath sufficiently loosely about its associated core (19) so that any such core (19) as well as any such sheath (21) are subsequently permanently deformed during the permanent elongation and compaction steps while not rupturing the sheath (21) and so as to adopt a cross sectional shape being none of circular, oval or elliptical.

18. The process of any one of examples 14 to 17 further comprising selecting to saturate most and preferably all of the fiber cores (19) with a lubricative substance that contacts the fibers prior to forming the layer (21), so as to minimize the potential for friction between various of the fibers, and selecting to conduct the saturating prior to forming the layers (21) about their associated cores (19), and prior to forming the strength member (7) from various of the strands (17).

19. The process of any one of examples 14 to 18 further comprising selecting for the strength member (7) a weight ratio of the ARAMID fibers relative to the HMPE, where said weight ratio is at minimum 80:20.

20. The process of claim 19 where said weight ratio is a minimum of 90:10.

21. The process of claim 20 where said weight ratio is a minimum of 97:3.

22. The process of any one of examples 17 to 21 further comprising selecting to form at least some and preferably each of said sheaths (21) from a film of HMPE.

23. The process of example 22 further comprising selecting to form and least some and preferably each of said sheaths (21) by selecting to wrap the film of HMPE around the core.

24. The process of any one of examples 17 to 22 further comprising selecting to form and least some and preferably each of said sheaths (21) as braided sheaths, and selecting for braid strands forming said braided sheaths a filament formed of HMPE film.

INDUSTRIAL APPLICABILITY

Ropes formed according to teachings of the present disclosure may be used as crane ropes, deep sea deployment and recovery ropes, tow ropes, towing warps, trawl warps (also known as "trawlwarps"), deep sea lowering and lifting ropes, powered block rigged mooring ropes, powered block rigged oil derrick anchoring ropes used with blocks and also with powered blocks, deep sea mooring ropes, deep sea winch lines, superwides and paravane lines used in seismic surveillance including but not limited to being used with towed arrays, yachting ropes, rigging ropes for pleasure craft including but not limited to sail craft, running rigging, powered block rigged anchor ropes, drag lines, and other.

Although the present disclosure has been described in terms of the presently preferred embodiment, it is to be understood that such disclosure is purely illustrative and is not to be interpreted as limiting. Consequently, without departing from the spirit and scope of the disclosure, various alterations, modifications and/or alternative applications of the disclosure are, no doubt, able to be understood by those ordinarily skilled in the art upon having read the preceding disclosure. Accordingly, it is intended that the following claims be interpreted as encompassing all alterations, modifications or alternative applications as fall within the true spirit and scope of the disclosure.

The invention claimed is:

1. A blended rope, the rope having an exterior sheath (8) enclosing at least a strength member (7), the strength member (7) having high-strength synthetic fibers, the strength member (7) being a blended strength member (7) formed with a combination of ARAMID fibers and HMPE fibers, the blended strength member comprising a non-heterogenous distribution of the ARAMID and HMPE fibers, the strength member further comprising main rope strands (17) each are formed with a primary strand sheath (21) that: (a) mainly is formed from HMPE filaments; and (b) encloses a core (19) mainly formed from ARAMID filaments.

2. The rope of claim 1 wherein the weight ratio of ARAMID to HMPE in the strength member (7) is in a range of 80:20 to 93:17.

3. The rope of claim 2 wherein at least some of the primary strand sheaths (21) are formed as a hallow braided construction formed of braid strands.

4. The rope of claim 3 wherein braid strands forming the hallow braided primary strand sheaths (21) comprise a filament of HMPE film.

5. The rope of claim 4 wherein the filaments of HMPE film do not rotate or twist about their own long axis for at least lengths of the strength member (7) that are a minimum of twenty centimeters in length.

6. The rope of claim 2 wherein the primary strand sheaths (21) comprise tape wrapped about the ARAMID core (19), wherein the tape comprises HMPE.

7. The rope of claim 1 wherein the weight ratio of ARAMID to HMPE in the strength member (7) is in a range of 80:20 to 99:1.

8. The rope of claim 1 wherein in at least some of the main rope strands (17) the ratio of ARAMID to HMPE is in a range of 80:20 to 100:0.

9. The rope of claim 1 wherein in at least some of the main rope strands (17) the ratio of ARAMID to HMPE is in a range of 95:5 to 100:0.

10. The rope of claim 1 wherein in at least some of the main rope strands (17) the ratio of ARAMID to HMPE is in a range of 99:1 to 100:0.

11. The rope of claim 1 wherein the at least a plurality of the main rope strands (17) includes at least half of the main rope strands (17).

12. The rope of claim 1 wherein the at least a plurality of the main rope strands (17) includes all of the main rope strands (17).

13. The rope of claim 1 wherein at least some of the primary strand sheaths (21) are formed as a hallow braided construction formed of braid strands.

14. The rope of claim 13 wherein braid strands forming the hollow braided primary strand sheaths (21) comprise a filament of HMPE film.

15. The rope of claim 14 wherein the filaments of HMPE film do not rotate or twist about their own long axis for at least lengths of the strength member (7) that are a minimum of twenty centimeters in length.

16. The rope of claim 1 wherein the primary strand sheaths (21) comprise tape wrapped about the ARAMID care (19), wherein the tape comprises HMPE.

17. A process for producing a rope having a blended strength member, the process having at least steps of:

providing a care (3) formed of thermoplastic;

forming a flow-shield sheath (5) around the thermoplastic core (3);

forming several main rope strands (17) where each main rope strand (17) comprises ARAM ID fibers and a material comprising HMPE;

loading a braiding machine capable of forming hollow braided sheaths with several of the main rope strands (17), and using the loaded braiding machine to form a braided strength member (7) around the combination of at least the thermoplastic core (3) and the flow-shield sheath (5);

next: while maintaining tension sufficiently to preserve a desired amount of elongation and compaction of the strength member, cooling the strength member and all it contains until the thermo-plastic core achieves a solid phase, the process characterized by that fact that the step of forming the several main rope strands (17) where each strand comprises ARAMID fibers and a material comprising HMPE further comprises a step of selecting a non-heterogenous distribution of the ARAMID fibers and the material comprising HMPE.

18. The process of claim 17 where the step of forming the several main rope strands (17) each with a core portion (19) comprising ARAMID fibers, and further comprises forming a primary strand sheath (21) situated at the exterior periphery of the core portion (19), where the primary strand sheath (21) comprises HMPE.

19. The process of claim 18 further comprising forming at least some of the primary strand sheaths (21) sufficiently tight about any of said cores (19) to reduce relative movement between ARAMID fibers forming said core portion (19) when no primary strand sheath (21) is present, while also forming the primary strand sheath (21) sufficiently loose so that any said core (19) is subsequently deformed during the permanent elongation and compaction of the strength member and acquires a non-circular and non-oval cross section in the final, permanently elongated and permanently compacted strength member (7).

* * * * *